US005871834A

United States Patent [19]

Wang

[11] Patent Number: 5,871,834

[45] Date of Patent: Feb. 16, 1999

[54] DECORATIVE ARTICLE OVERLAID WITH IRIDESCENT FILM

[76] Inventor: Sui-Mu Wang, P.O. Box 55-846, Taipei, Taiwan

[21] Appl. No.: 929,257

[22] Filed: Sep. 15, 1997

[51] Int. Cl.[6] ..... D06N 7/04

[52] U.S. Cl. ..... 428/141; 359/359; 359/360; 428/142

[58] Field of Search ..... 427/256, 162; 359/359, 360; 428/141, 142

[56] References Cited

U.S. PATENT DOCUMENTS 4,832,453 5/1989 Saad-Cook ..... 350/321
5,278,694 1/1994 Wheatley et al. ..... 359/359

*Primary Examiner*—Michael Lusignan

[57] ABSTRACT

A decorative article includes: an iridescent film translucent or transparent overlaid on a substrate member which may be a color sheet, and a filler layer formed beneath the substrate member, whereby upon molding or welding of the iridescent film, the substrate member and the filler layer to form three-dimensional decorative feature having protrusions and recesses on an upper or outer surface of the decorative article to reveal the iridescent colors as reflected by the iridescent film in cooperation with a background color or contrast color of the substrate member for forming shimmer multiple colors for enriching the decorative effect. The article overlaid with the iridescent film will prevent scratching, fading or oxidation defects as found in a conventional electroplated decorative item.

4 Claims, 3 Drawing Sheets

FIG. 7
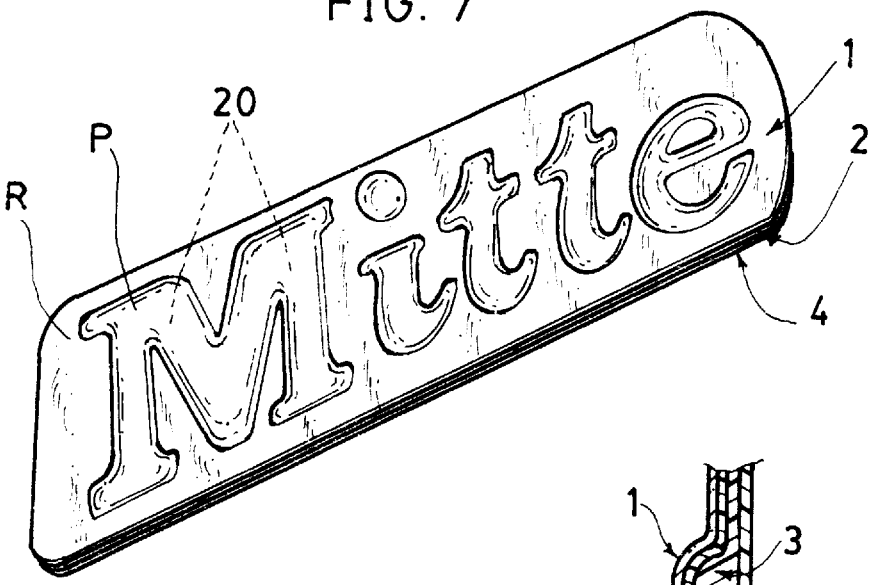
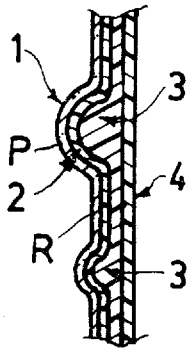
FIG. 5
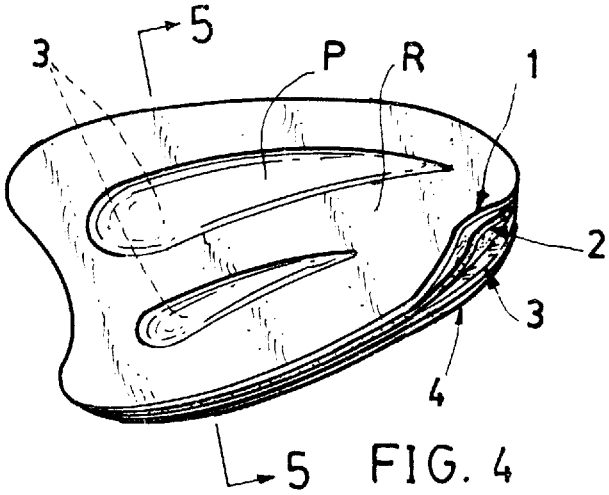
FIG. 4
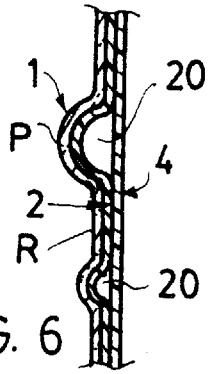
FIG. 6

DECORATIVE ARTICLE OVERLAID WITH IRIDESCENT FILM

BACKGROUND OF THE INVENTION

A conventional logo, mark or decorative item such as formed on a footwear or a commercial product may be electroplated with gold, silver or other colors for enriching ornamental effect.

However, the electroplated product has the following drawbacks:

1. By electroplating metal on a decorative item may increase the production cost.
2. The surface metal film as deposited on the decorative item may be scratched, faded, or damaged to lose its decorative feature.
3. The electroplating process may produce waste water containing poisonous heavy metal, being hazardous to human health and influencing environmental protection.
4. The electroplating process is quite limited, especially for the basic working piece having complex geometric configuration, curvatures or structures, thereby increasing the processing complexity or even being unable for electroplating.
5. The electroplated product may have weak water and weather resistance, easily losing their brightness and gloss and thereby decreasing their decorative effect.

The present inventor has found the drawbacks of the conventional decorative item by electroplating method, and invented the present decorative article overlaid with iridescent film.

SUMMARY OF THE INVENTION

The object of the present invention is to provide a decorative article including: an iridescent film translucent or transparent overlaid on a substrate member which may be a color sheet, and a filler layer formed beneath the substrate member, whereby upon molding or welding processing of the iridescent film, the substrate member and the filler layer to form three-dimensional decorative feature having protrusions and recesses on an upper or outer surface of the decorative article to reveal the iridescent colors as reflected by the iridescent film in cooperation with a background color or contrast color of the substrate member for forming shimmer multiple colors for enriching the decorative effect, while preventing the scratching, fading or oxidation defects of a conventional electroplated decorative film.

BRIEF DESCRIPTION OF THE DRAWINGS

FIG. 4 is a perspective view of another preferred embodiment of the present invention.

FIG. 5 is a sectional drawing of the present invention when viewed from 5—5 direction of FIG. 4.

FIG. 6 is a sectional drawing of the present invention as modified from FIG. 5.

FIG. 7 shows still another preferred embodiment of the present invention.

DETAILED DESCRIPTION

Figure 1:
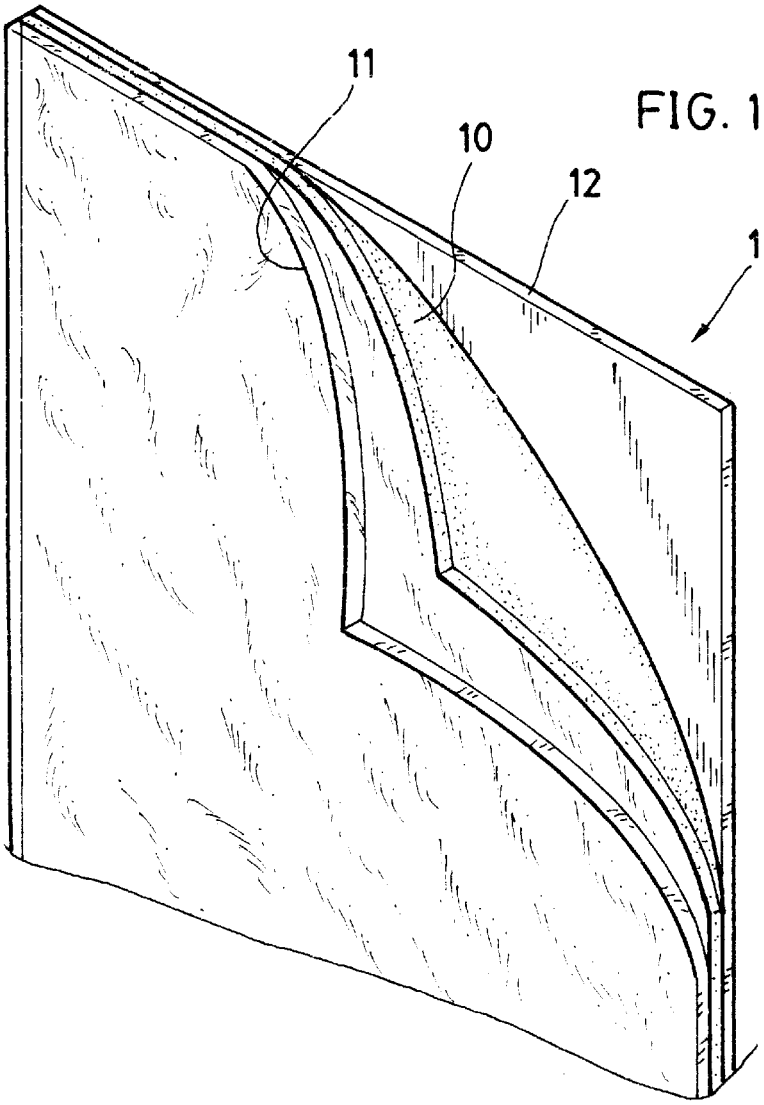
FIG. 1 is a partially exploded view of the iridescent film of the present invention.
Figure 3:
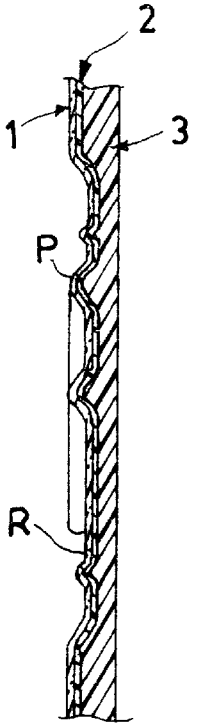
FIG. 3 is a sectional drawing of the present invention when viewed from 3—3 direction of FIG. 2.
Figure 2:
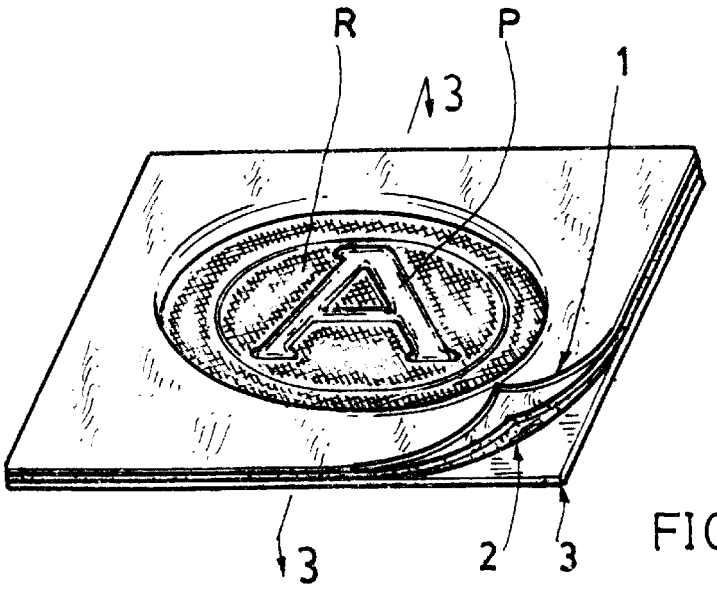
FIG. 2 is a perspective view of the present invention.

As shown in FIGS. 1–3, the decorative article of the present invention comprises: an iridescent film 1 translucent or transparent overlaid on a substrate member 2 which is a color sheet or member bonded beneath the iridescent film 2, and a filler layer 3 integrally formed beneath the substrate member 2; with the iridescent film 1, the substrate member 2 and the filler layer 3 being molded by plastic molding processes such as by compression molding, thermoforming, and other molding processes for forming three-dimensional configuration having at least one protrusion P and one recess R formed on an upper or outer surface of the decorative article.

The materials for making the substrate member 2 and the filler layer 3 may be selected from plastic or rubber materials.

The iridescent film 1 as shown in FIG. 1 includes: a laminated film 10 consisting of a plurality of (such as 5–7) transparent or translucent thin membranes laminated and superimposed one another for displaying a spectrum of colors or iridescent colors as reflected from the plural surfaces of the thin membranes that shimmer and change due to interference and scattering as the observer's (eyes) position changes; an outer transparent layer 11; and an inner transparent layer 12 with the laminated film 10 sandwiched in between the outer and inner transparent layers 11, 12 for protecting the laminated film 10 by the outer and inner transparent layers 11, 12. The film 1 may be made of polymethyl methacrylate, polystyrene, polyethylene, and other transparent thin film materials.

The substrate member 2 is colored with pigments or dyestuffs forming a background color or a contrast color in contrast to or being commensurate with the iridescent colors as produced from the iridescent film 1 overlaid on an outer or upper layer of the decorative article of the present invention. The substrate member 2 may be a thin layer or sheet bonded with the iridescent film 1 when subjected to plastic molding processes.

The filler layer 3 is bonded, laminated or superimposed with the substrate member 2 and the iridescent film 1 by any conventional processing methods to form three-dimensional decorative feature, logo, mark, letter or words having at least one protrusion P and one recess R as shown in FIGS. 2, 3. Naturally, the filler layer 3 may also be omitted to form a hollow interior 20 in each protrusion P of the decorative article when obtained from molding processes.

The molding processes which may be used in this invention includes: compression molding, vacuum forming, thermoforming, injection molding, etc. For well bonding the multiple layers of the elements in construction of the decorative article of the present invention, a high-frequency welding may be used for firmly welding the plural layers together.

The present invention may be used for: a logo or trademark plate, a nameplate, a badge, a medal, or any other decorative items or articles, not limited.

As shown in FIGS. 4 & 5, the present invention further comprises a bottom (or back) cover 4 integrally formed or additionally adhered or bonded beneath the filler layer 3. The bottom cover 4 is provided to smooth or flatten the bottom (back) side of the multiple layers of the decorative article of the present invention.

If the filler layer 3 is omitted to allow the hollow interiors 20 existing in the protrusions P of the article, the bottom cover 4 is essentially required for forming a flat smooth bottom (back) surface of the decorative article as shown in FIG. 6.

FIG. 7 also shows a hollow interior 20 formed in each protruded letter of the word mark which is provided just for illustration purpose only, without any meaning such as to allege the design or creation of the mark. By the way, the iridescent film 1 and the substrate member 2 may be molded by thermoforming process to be bonded together to form the protrusions P and the recesses R for ornamental effect. Then, a bottom cover 4 is attached thereto such as by welding, adhesive bonding or any other processes. Naturally, the bottom cover 4 may also be eliminated if the flat bottom or back surface is not so essentially required.

Figure 8:
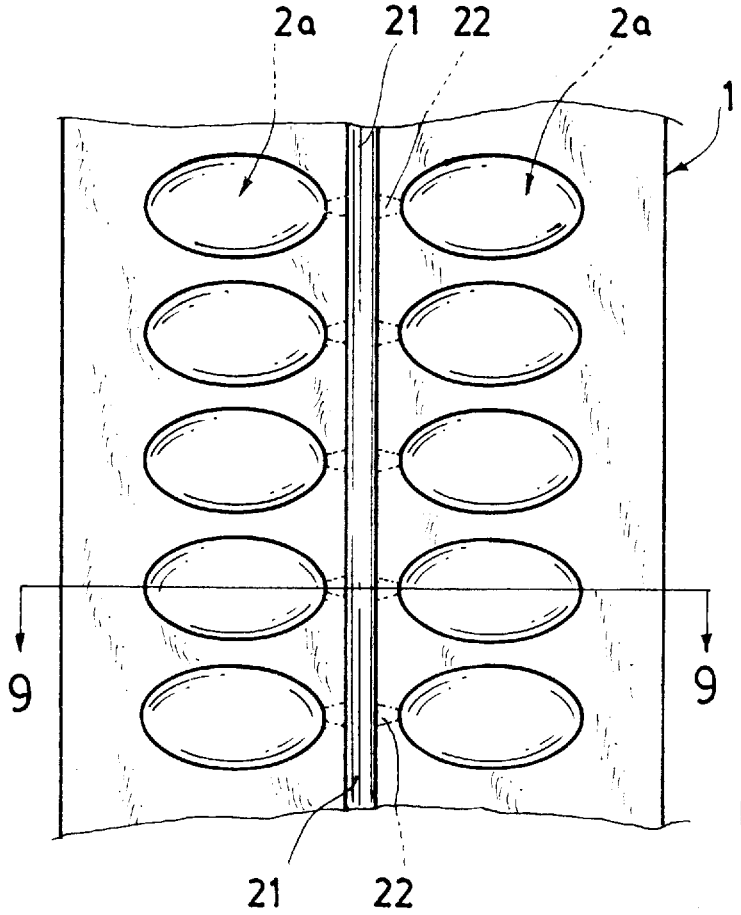
FIG. 8 is a top view of further preferred embodiment of the present invention.
Figure 9:
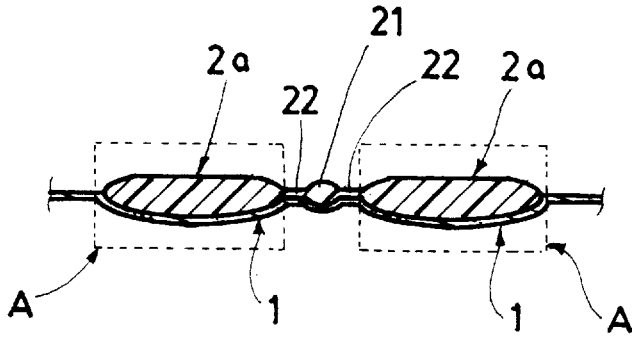
FIG. 9 is a sectional drawing as viewed from 9—9 direction of FIG. 8.

As shown in FIGS. 8, 9, the present invention may use an injection molding process to form a plurality of substrate members 2*a* of deep or contrast color integrally bonded with a surface layer of the iridescent film 1 having iridescent colors reflected from the film 1, each substrate member 2*a* attached to a "trunk" 21 through a branch member 22 as released from an injection mold (not shown). After releasing from the mold, the branches 22 and the trunk 21 may be removed and severed to obtain the plural decorative items A as marked in FIG. 9. Each decorative item A includes a surface iridescent film 1 and a solid substrate member 2*a* bonded beneath the film 1. A brilliant shimmer iridescent color from the film 1 in contrast to the contrast color formed in the substrate member 2*a* will synergetically form multiple colors for greatly enhancing a multiple-color decorative effect. The decoration color can be varied by adding the iridescent colors of film 1 and the background color (which can be varied or adjusted) of substrate member 2.

The present invention is superior to the conventional electroplated decorative items with the following advantages:

1. The iridescent film 1 has its own outer transparent layer 21 for a self protection for minimizing wearing or scratching damages and for a better environmental or weather resistance.

2. Production cost is greatly reduced by eliminating the high-cost electroplating process.

3. Air and water pollution can be efficiently prevented since no contamination is caused by eliminating the electroplating process.

4. Shapes and configurations can be ideally obtained by a suitable molding process.

The present invention may be modified without departing from the spirit and scope of the present invention. For instance, the substrate member 2, 2*a* may also be made with transparent color and formed with at least a convex portion to provide a lens so that the shimmer iridescent colors from the film 1 will be observed through the decorative article by light reflection, deflection and transmission.

I claim:

1. A decorative article comprising:

A transparent iridescent film for producing iridescent colors overlain on a substrate member which forms a background color in contrast to the iridescent colors from said iridescent film;

said iridescent film including:

a laminated film consisting of a plurality of transparent thin membranes laminated and superimposed one another for displaying a spectrum of iridescent colors as reflected from a plurality of surfaces of the thin membranes that shimmer and change due to interference and scattering as an observer's position changes, an outer transparent layer, and an inner transparent layer with the laminated film sandwiched in between the outer and inner transparent layers for protecting the laminated film between the outer and inner transparent layers;

the improvement which comprises:

said iridescent film bonded with said substrate member by a molding process for forming a three-dimensional decorative feature having at least a protrusion and at least a recess formed on an upper and outer surface of said decorative article; whereby upon bonding of said iridescent film on said substrate member, said iridescent colors as being commensurate with the background color as produced by said substrate member will reveal synergetic multiple colors for enhancing decorative effect of the decorative article.

2. A decorative article according to claim 1, wherein said substrate member is bonded with a filler layer beneath said substrate member for filling each said protrusion as formed in said decorative article.

3. A decorative article according to claim 2, wherein said substrate member further includes a bottom cover attached on a bottom surface of said substrate member for forming flat smooth surface of said substrate member.

4. A decorative article according to claim 1, wherein said protrusion formed by said film and said substrate member defines a hollow interior in said protrusion, and said substrate member further includes a bottom cover attached thereto to seal a bottom surface of said substrate member and to seal the hollow interior formed in said substrate member.

* * * * *